US009498784B2

(12) United States Patent
Cheng et al.

(10) Patent No.: US 9,498,784 B2
(45) Date of Patent: Nov. 22, 2016

(54) BIO-CHIP AND METHOD FOR SEPARATING AND CONCENTRATING PARTICLES USING THE SAME

(71) Applicant: National Applied Research Laboratories, Taipei (TW)

(72) Inventors: I-Fang Cheng, Tainan (TW); Fu-Liang Yang, Hsinchu (TW); Hsien-Chang Chang, Tainan (TW); Tzu-Ying Chen, Tainan (TW)

(73) Assignee: NATIONAL APPLIED RESEARCH LABORATORIES, Taipei (TW)

( * ) Notice: Subject to any disclaimer, the term of this patent is extended or adjusted under 35 U.S.C. 154(b) by 502 days.

(21) Appl. No.: 14/030,830

(22) Filed: Sep. 18, 2013

(65) Prior Publication Data

US 2014/0083855 A1 Mar. 27, 2014

(30) Foreign Application Priority Data

Sep. 21, 2012 (TW) ..... 101134715 A

(51) Int. Cl.
*B03C 5/00* (2006.01)
*B03C 5/02* (2006.01)

(52) U.S. Cl.
CPC ..... *B03C 5/005* (2013.01); *B03C 5/026* (2013.01); *B03C 2201/26* (2013.01)

(58) Field of Classification Search
None
See application file for complete search history.

(56) References Cited

U.S. PATENT DOCUMENTS

2005/0014146 A1* 1/2005 Manaresi ..... B03C 5/005 435/6.12
2010/0155246 A1* 6/2010 Schnelle ..... B01L 3/502761 204/547

OTHER PUBLICATIONS

Cheng, I.-F., et al. "A dielectrophoretic chip with a roughened metal surface for on-chip surface-enhanced Raman scattering analysis of bacteria" Biomicrofluidics, vol. 4, Sep. 2010, p. 034104-1-034104-11.*
Huang, Y., et al. "Dielectrophoretic cell separation and gene expression profiling on microelectronic chip arrays" Analytical Chemistry, vol. 74, No. 14, Jul. 15, 2002, p. 3362-3371.*

* cited by examiner

*Primary Examiner* — J. Christopher Ball
(74) *Attorney, Agent, or Firm* — Christensen O'Connor Johnson Kindness PLLC

(57) ABSTRACT

A bio-chip adapted for separating and concentrating particles in a solution includes a chip body defining a receiving space therein for receiving the solution, an inner electrode disposed in the receiving space, an outer electrode unit disposed in the receiving space of the chip body and including a first outer electrode that is spaced apart from and surrounds the inner electrode, and a second outer electrode that is spaced apart from and surrounds the first outer electrode, and a power source electrically connected to the inner electrode, the first outer electrode, and the second outer electrode. A method for using the bio-chip to separating and concentrating the particles in the solution is also disclosed in the present invention.

22 Claims, 10 Drawing Sheets

(a)

(b)

(c)

BIO-CHIP AND METHOD FOR SEPARATING AND CONCENTRATING PARTICLES USING THE SAME

CROSS-REFERENCE TO RELATED APPLICATION

This application claims priority of Taiwanese Patent Application No. 101134715, filed on Sep. 21, 2012.

BACKGROUND OF THE INVENTION

1. Field of the Invention

This invention relates to a bio-chip, more particularly to a bio-chip adapted for separating and concentrating particles in a solution.

2. Description of the Related Art

Raman spectroscopy has become a popular technique for determining microorganism species. Unlike conventional methods for microorganism detection that need professionals having particular skills to perform, for example, DNA extraction, nucleic acid detection, fluorescent labeling, or biochemistry analysis, microorganism species can be determined by directly comparing spectroscopic spectrum of a sample to be detected with reference spectra.

While Raman spectroscopy is first adopted for microorganism detection, a high concentration (above $10^{12}$ colony forming units (CFU)/ml) of a target microorganism is required for generating a signal that is strong enough to be detected, and characteristic peaks of the spectroscopic spectrum are not really significant. Also, a further purification process for samples is required to perform Raman spectroscopy detection so as to obtain the spectroscopic fingerprint specific to a target microorganism.

It is reported to utilize a substrate having a roughened surface to trap target microorganism thereon for performing Raman spectroscopy technique, so that a surface-enhanced Raman spectroscopic (SERS) signal is obtained. However, such method is not applicable to unpurified samples.

A conventional method to concentrate a target microorganism in a purified sample solution for Raman spectroscopy detection is to generate ring stains (also called "coffee ring") from drops of the purified sample solution. The target microorganism in the sample drops are subjected to surface tension and cohesive forces and thus are concentrated in the ring stains while drying the sample drops. However, the method is still not applicable to unpurified samples.

From the methods describing above, a major obstacle while performing Raman spectroscopic detection relies on that a purified sample is needed instead of an actual sample, such as human blood containing variety of non-target materials, for instance, blood cells, proteins, and so forth. The non-target materials would generate spectroscopic fingerprints as well, thereby interfering the spectroscopic fingerprint of the target microorganism. Moreover, drying time for generating the ring stain is relatively long, e.g., if the volume of the sample is greater than 10 μL, the drying time is about half an hour.

Recently, a method for capturing target microorganism by utilizing a chemical/antibody-modified silver/anodic aluminum oxide (AAO) substrate is disclosed. The Ag/AAO substrate is modified with Vancomycin thereon for capturing bacteria from the mixture of bacteria-blood cells, and SERS signal is thus enhanced. However, it takes a large amount of time for the target bacteria to be binding with Vancomycin on the substrate, and not all bacteria are capable of being recognized by Vancomycin.

From describing herein above, the applicant thinks that adopting a bio-chip, which is capable of separating and concentrating the target particles in actual samples (i.e., mixture samples), combined with Raman spectroscopy is the right track for developing an ultra-fast and precise detection method of microorganism species in the actual samples without further purification. However, in Taiwanese Patent Application No. 100110372, No. 098123205, NO. 099100678, and No. 095139596, methods or chips disclosed therein have several disadvantages such as requirement of high microorganism concentration ($10^6$ CFU/ml to $10^2$ CFU/ml), relatively small detecting area, requirement of further purification for target microorganisms, and low selectivity for the target microorganisms. Thus, there is a need in the art to provide a bio-chip that can overcome the aforesaid drawbacks.

SUMMARY OF THE INVENTION

Therefore, one object of the present invention is to provide a bio-chip for concentrating and separating particles in a solution effectively. Another object of the present invention is to provide a method for separating and concentrating particles selectively in a solution using the aforesaid bio-chip.

According to a first aspect of this invention, a bio-chip adapted for separating and concentrating particles in a solution includes:

a chip body defining a receiving space therein for receiving the solution;

an inner electrode disposed in the receiving space of the chip body;

an outer electrode unit disposed in the receiving space of the chip body and including a first outer electrode that is spaced apart from and surrounds the inner electrode, and a second outer electrode that is spaced apart from and surrounds the first outer electrode.

According to a second aspect of this invention, a method for separating and concentrating particles in a solution includes the following steps of:

(a) providing a solution containing a plurality of first particles with a first average diameter and a plurality of second particles with a second average diameter smaller than the first average diameter;

(b) providing a bio-chip including a chip body defining a receiving space therein, an inner electrode disposed in the receiving space of the chip body, and an outer electrode unit disposed in the receiving space of the chip body and including a first outer electrode that is spaced apart from and surrounds the inner electrode, and a second outer electrode that is spaced apart from and surrounds the first outer electrode;

(c) placing the solution in the receiving space of the chip body of the bio-chip; and (d) applying a biased AC voltage to generate non-uniform AC electric fields between the adjacent two of the inner electrode and the first and second outer electrodes such that an electrohydrodynamic (EHD) force is generated in the solution, such that each of the first particles is subjected to a first dielectrophoresis (DEP) force that is less than the EHD force, and such that each of the second particles is subjected to a second dielectrophoresis (DEP) force that is greater than the EHD force.

BRIEF DESCRIPTION OF THE DRAWING

Other features and advantages of the present invention will become apparent in the following detailed description of the preferred embodiments of this invention, with reference to the accompanying drawings, in which.

DETAILED DESCRIPTION OF THE PREFERRED EMBODIMENT

Figure 1:
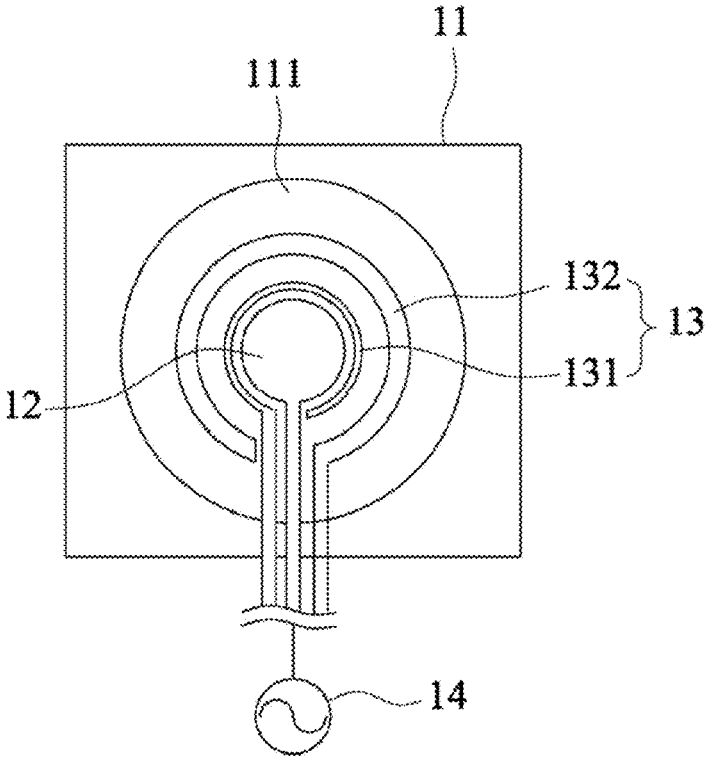
FIG. 1 is a top view of a bio-chip of the first preferred embodiment according to the present invention.

Before the present invention is described in greater detail, it should be noted that like elements are denoted by the same reference numerals throughout the disclosure.

Figure 2:
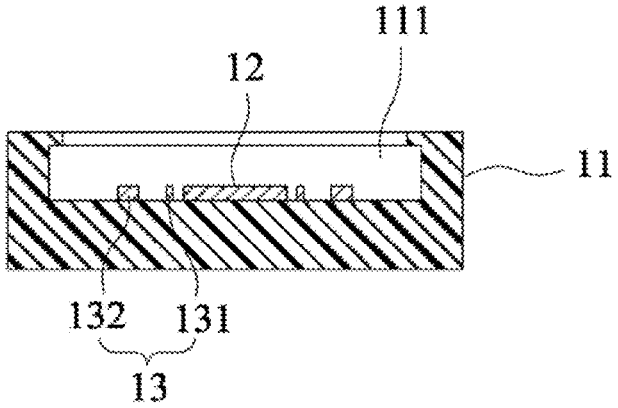
FIG. 2 is a side view of the first preferred embodiment.
Figure 3:
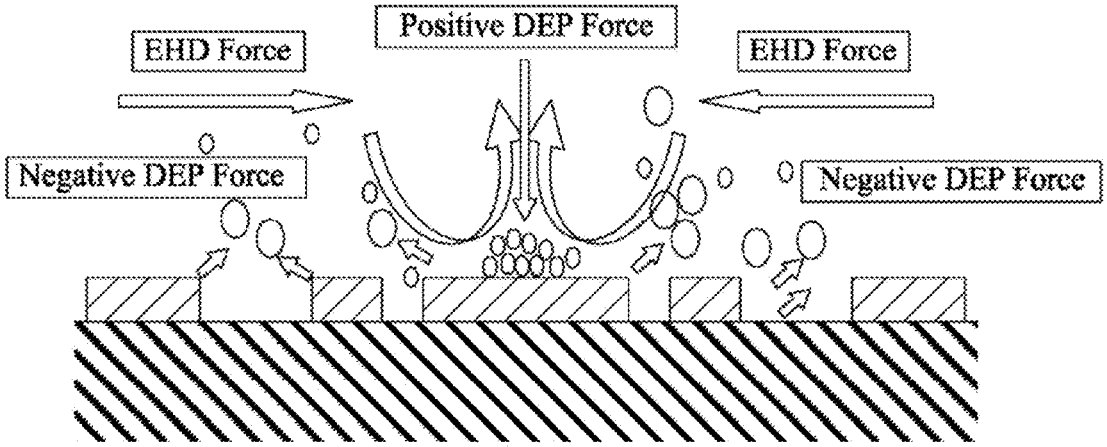
FIG. 3 is a schematic diagram describing that the forces exerted on particles of a solution disposed in the bio-chip of the present invention.

Referring to FIGS. 1 and 2, a bio-chip of the first preferred embodiment according to the present invention is adapted for separating and concentrating particles in a solution and is disclosed to include a chip body 11, an inner electrode 12, an outer electrode unit 13, and a power source 14. The particles contained in the solution include first particles with a first average diameter and second particles with a second average diameter that is smaller than the first average diameter, and each of the first and second average diameter is in micrometer or nanometer scale. The ratio of the first average diameter to the second average diameter is not less than 1.5 when the first and second average diameters of the first and second particles are in micrometer scale, and the ratio of the first average diameter to the second average diameter is not less than 10 when the first and second average diameters of the first and second particles are in nanometer scale.

The chip body 11 is configured substantially as a plate shape and defines a receiving space 111 therein for receiving the solution. The inner electrode 12 is a circular gold foil and is disposed in the receiving space 111 of the chip body 11. It should be noted that the inner electrode 12 can be made of another suitable material and should not be limited in this embodiment.

The outer electrode unit 13 is disposed in the receiving space 111 of the chip body 11 and has a first outer electrode 131 spaced apart from and surrounding the inner electrode 12, and a second outer electrode 132 spaced apart from and surrounding the first outer electrode 131. Preferably, the first outer electrode 131 is equidistantly spaced apart from the inner electrode 12, and the second outer electrode 132 is equidistantly spaced apart from the first outer electrode 131, i.e., the inner electrode 12 and the first and second outer electrodes 131 and 132 are arranged concentrically. Each of the first and second outer electrodes 131 and 132 is substantially an annular foil, which is made of gold or platinum, and has an annular outer periphery and an annular inner periphery to define a width, preferably a uniform width, therebetween. The width of the second outer electrode 132 is greater than that of the first outer electrode 131. Preferably, the ratio between the widths of the second and first outer electrodes 132 and 131 is not less than 2.828. Preferably, the ratio of the distance between the first outer electrode 131 and the second outer electrode 132 over the distance between the inner electrode 12 and the first outer electrode 131 is not less than 2.828.

The power source 14 is electrically connected to the inner electrode 12 and the first and second outer electrodes 131 and 132, and is operable for supplying a biased AC voltage (ranging from 5 to 15 V) with a predetermined frequency (ranging from 300 Hz to 20 MHz) between the inner electrode 12 and each of the first and second outer electrodes 131 and 132, such that a non-uniform AC electric field is generated between the adjacent two of the inner electrode 12 and the first and second outer electrodes 131 and 132 and ranges from $10^4$ to $10^8$ V/m. For example, the power source 14 is preferable to generate the non-uniform AC electric field of $10^5$ V/m to separate bacteria from human blood cells.

When the bio-chip of this invention is used for separating and concentrating the first and second particles in a solution, after placing the solution in the receiving space 111 of the chip body 11, the power source 14 supplies an biased AC voltage (ranging from 5 to 15 V) with a predetermined frequency (ranging from 300 Hz to 20 MHz) to the inner electrode 12 and the first and second outer electrodes 131 and 132 to generate non-uniform AC electric fields between the adjacent two of the inner electrode 12 and the first and second outer electrodes 131 and 132. Therefore, an electrohydrodynamics (EHD) effect is generated in the solution, each of the first particles is subjected to a first dielectrophoresis (DEP) force, and each of the second particles is subjected to a second dielectrophoresis (DEP). To be specific, ions in the solution are driven by the resultant non-uniform AC electric field, so as to form electrical double layers on a surface of each of the inner electrode 12 and the first and second outer electrodes 131 and 132, as well as generating charge migration in the solution, thereby generating a bulk flow in the solution. Such phenomenon is known as electrohydrodynamics including AC electroosmostic and AC electrothermal flows. Due to the electrohydrodynamics, the electrohydrodynamics (EHD) force is generated in the solution and exerted on the first and second particles to transport the first and second particles in the solution. In the meantime, the first and second particles are induced to form induced dipoles by the non-uniform electric field, such that the first and second particles are respectively subjected to first and second dielectrophoretic (DEP) forces due to the polarization variation between solvent molecules and the first and second particles, thereby driving the second particles having smaller average diameter to concentrate onto the inner electrode 12.

For example, if the solution is human blood (i.e., an unpurified mixture sample), the first particles may be blood cells and the second particles may be bacteria which have smaller average diameter than that of the blood cells. When conductivity of the solution (i.e., the human blood) is low (1 μS/cm to 500 μS/cm) with provided AC voltages having a frequency ranging from 300 Hz to 100 kHz, the blood cells (having larger average diameter) suffers negative DEP force to be repelled from the high electric field regions (i.e., the inner electrode 12, and the first and second outer electrodes 131 and 132), and the bacteria (having smaller average diameter) suffers positive DEP forces to be attracted to the high electric field regions (i.e., the inner electrode 12, and the first and second outer electrodes 131 and 132). Besides, both of the blood cells and the bacteria are also subjected to force from the electroosmosis flow, thereby being transported toward the inner electrode 12. Thus, if the positive DEP of the bacteria is weaker than the electroosmosis effect, the bacteria may be transported toward the inner electrode 12 and accumulate on the inner electrode 12. If the negative DEP of the blood cells is stronger than the electroosmosis effect, the blood cells may be retained between the first and second outer electrodes 131 and 132, and between the inner electrode 12 and the first outer electrode 131. Raman spectroscopy then may be performed on the inner electrode 12, where the bacteria are accumulated, to obtain Raman spectroscopic fingerprints of the bacteria.

On the other hand, when conductivity of the solution is relatively high (0.5 mS/cm to 15 mS/cm) with provided AC voltages having a frequency ranging from 500 kHz to 20 MHz, the blood cells and the bacteria both suffer from positive DEP at this high frequency range, thereby being attracted to the stronger electric field regions (i.e., the electrodes). However, the DEP force is proportional to the cube of a particle diameter, so that particles with different diameters suffer from different degrees of DEP forces. If the positive DEP of the blood cells is stronger than the electrothermal effect while positive DEP of the bacteria is weaker than the electrothermal effect, the bacteria are capable of being separated from the blood cells and concentrated onto the inner electrode 12.

Figure 4:
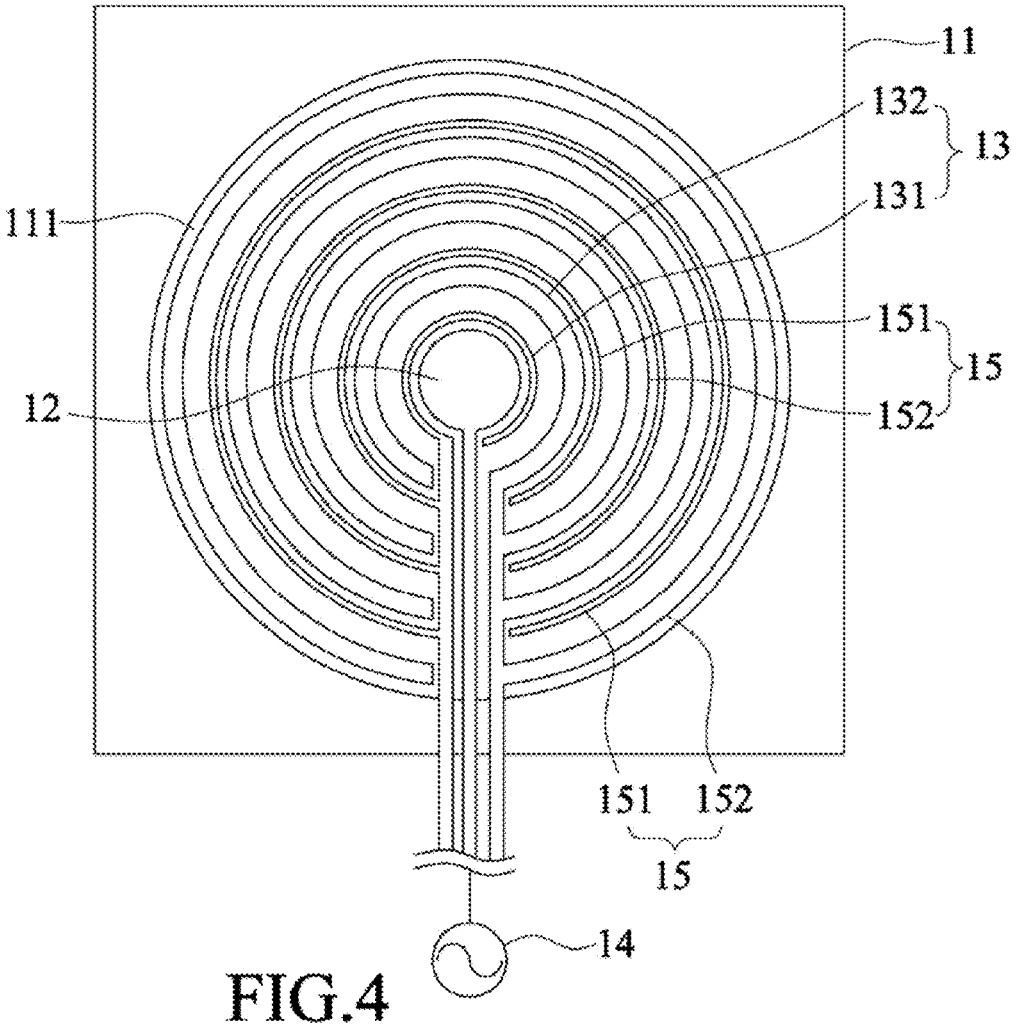
FIG. 4 is a top view of a bio-chip of the second preferred embodiment according to the present invention.
Figure 5:
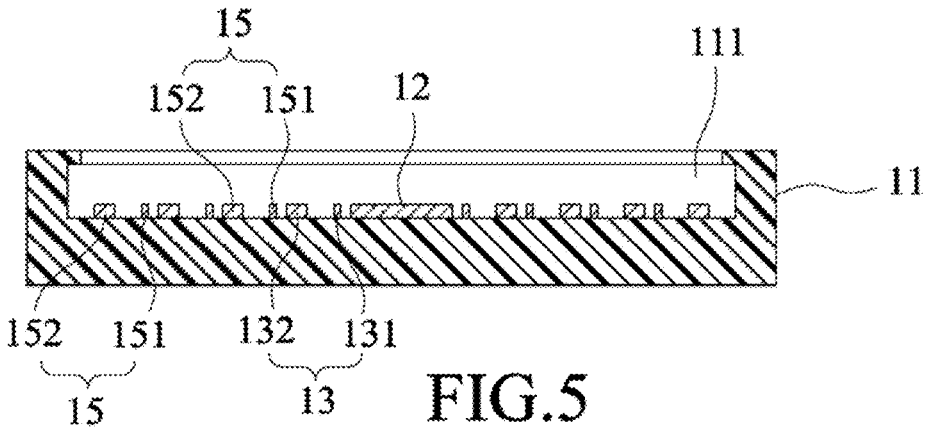
FIG. 5 is a side view of the second preferred embodiment.

Referring to FIGS. 4 and 5, a bio-chip of the second preferred embodiment of the present invention is similar to that of the first preferred embodiment. The main difference between the first and second preferred embodiments resides in that the bio-chip of the second embodiment further includes at least one auxiliary electrode unit 15. In this embodiment, three auxiliary outer electrode units 15, i.e., first, second, and third auxiliary outer electrode units, are present and arranged spacedly apart from the outer electrode unit 13 in the ordered sequence.

The auxiliary outer electrode units 15 are disposed in the receiving space 111 of the chip body 11 and are electrically connected to the power source 14. Each of the auxiliary outer electrode units 15 includes a first auxiliary outer electrode 151 and a second auxiliary outer electrode 152. For the first auxiliary outer electrode unit 15, the first auxiliary outer electrode 151 is spaced apart from and surrounds the second outer electrode 132 of the outer electrode unit 13, and the second auxiliary outer electrode 152 is spaced apart from and surrounds the first auxiliary outer electrode 151. In each of the auxiliary outer electrode units 15, each of the first and second auxiliary outer electrodes 151 and 152 is an annular foil made of gold or platinum, and has an annular outer periphery and an annular inner periphery to define a width, preferably an even width, therebetween. In each of the auxiliary outer electrode units 15, the width of the second auxiliary outer electrode 152 is greater than that of the first auxiliary outer electrode 151. Preferably, in each of the auxiliary outer electrode units 15, the ratio between the widths of the second and first auxiliary outer electrodes 152 and 151 is larger than 2.828. Preferably, in the first auxiliary outer electrode unit 15, the ratio of the distance between the first and second auxiliary outer electrodes 151 and 152 over the distance from the first auxiliary outer electrode 151 to the second outer electrode 132 of the outer electrode unit 13 is not less than 2.828. Similarly, the ratio of the distance between the first and second auxiliary outer electrodes 151 and 152 of the second auxiliary outer electrode unit 15 over the distance from the first auxiliary outer electrode 151 of the second auxiliary outer electrode unit 15 to the second auxiliary outer electrode 152 of the first auxiliary outer electrode unit 15 is not less than 2.828. The distance ratio is also shown in the third auxiliary outer electrode unit 15. Preferably, the inner electrode 12, the outer electrode unit 13, and the auxiliary outer electrode units 15 are arranged concentrically.

When the power source 14 is operable to supply biased AC voltages to the inner electrode 12, the first and second outer electrodes 131 and 132, and the first and the second auxiliary outer electrodes 151 and 152 of each of the auxiliary outer electrode units 15, the first and second particles in the solution subject to positive or negative DEP forces and EHD forces, so as to separate and concentrate the second particles substantially onto the inner electrode 12. By virtue of the auxiliary electrode units 15, a relatively large electric field region is created, thereby resulting in increases in concentrating and separating efficiencies.

It should be mentioned that, in the first and second preferred embodiments, the inner electrode 12 of the bio-chip may further have a roughened binding surface that is formed with a plurality of nano-structures, so as to generate surface plasma resonance and electron transfer effects. Thus, the Raman spectroscopic fingerprints for the target particles can be effectively enhanced. The inner electrode 12 may further or alternatively includes a probe, such as an antibody probe or a nucleic acid probe thereon for selectively binding the target particles, like bacteria, proteins, or nucleic acids and so forth, and enhancing the Raman spectroscopic fingerprints of the target particles.

It should be noted that the shapes of the inner electrode 12 and the electrodes of the outer electrode unit 13 and the auxiliary electrode units 15 should not be limited in the first and second preferred embodiments. For example, the shape of the inner electrode 12 can be polygon, and the shapes of the first and second outer electrodes 131 and 132, or the first and the second auxiliary outer electrodes 151 and 152 of each of the auxiliary electrode units 15 could be a polygonal ring.

It should be noted that the strength of the electric field generated by the power source 14 may vary based on sizes of the particles. For example, the critical strength of the electric field for preventing viruses and proteins from transporting to the inner electrode 12 is about $10^8$ V/m, and the critical strengths for bacteria, fungi, and cells (like blood cells) are about $10^8$ V/m, $10^5$ V/m, and $10^4$ V/m respectively. That is, if the applied electric field is higher than $10^6$ V/m, the bacteria cannot be transported into the inner electrode 12 and particles smaller than the bacteria such as viruses and protein can be transported to and concentrated onto the inner electrode 12. If separation between the bacteria and the blood cells is needed, the generated electric field should range from $10^4$ V/m to $10^6$ V/m so that the bacteria can be concentrated onto the inner electrode 12 and the blood cells are repelled from the inner electrode 12. For separation between the viruses and the blood cells and between viruses and cells, the generated electric field should range from $10^4$ V/m to $10^8$ V/m and from $10^6$ V/m to $10^8$ V/m respectively.

Furthermore, the bio-chip according to the present invention is preferably manufactured via micro-electrical-mechanical system (MEMS) techniques, so that the inner electrode 12, the first and second outer electrodes 131 and 132, and the first and second auxiliary outer electrodes 151 and 152 may be arranged in a 3-dimensional manner. That is, target particles may be transported by flows without being limited by the boundary effect, thereby enhancing separating and concentrating efficiencies of the target particles. For example, referring to FIG. 11(*a*) to FIG. 11(*d*), a variation of the bio-chip of the present invention can be configured to have a bottom electrode 2 served as the inner electrode unit 12 of the first preferred embodiment, and a top electrode plate 3 that is disposed on and spaced apart from the bottom electrode 2 and that serves as the outer electrode unit 13 of the first preferred embodiment. As shown in FIG. 11(*a*), by utilizing the identical DEP and EHD effects, particles with different sizes can be effectively selected and concentrated on the bottom electrode 2. The bottom electrode 2 may have different configurations (see FIG. 11(*b*) and FIG. 11(*c*)). Additionally, this kind of 3-D design may further include an auxiliary bottom electrode 4 having a central portion 41 surrounding the bottom electrode 2 and a plurality of angularly spaced-apart extending portions 42 extending outwardly from the central portion 41 for creating transportation of particles in a larger area toward the bottom electrode 2 via the EHD effect to further enhance concentrating efficiency of the bio-chip of this invention.

EXAMPLE

[Bacteria Detection in Blood Sample]

The bio-chip of the first preferred embodiment was provided, wherein the inner electrode 12 was made of gold and had a roughened surface that is formed with a plurality of nano-structures and that is capable of enhancing the Raman spectroscopic signals due to surface plasma resonance effect. Widths of the first and second outer electrodes 131 and 132 were 25 μm and 100 μm respectively. The distance between the inner electrode 12 and the first outer electrode was 25 μm and the distance between the first and the second outer electrode 131 and 132 was 100 μm. The power source 14 supplied 8 Vpp and 12 Vpp to the first and second outer electrodes 131 and 132 respectively, and the inner electrode 12 was grounded. The power source 14 also applied a DC voltage of 0.5 V between the inner electrode 12 and the first outer electrode 131, and between the inner electrode 12 and the second outer electrodes 132, so that a non-uniform electric field was formed to generate a biased AC electroosmosis flow and thus drove particles toward a stagnation point of the inner electrode 12.

Figure 6:
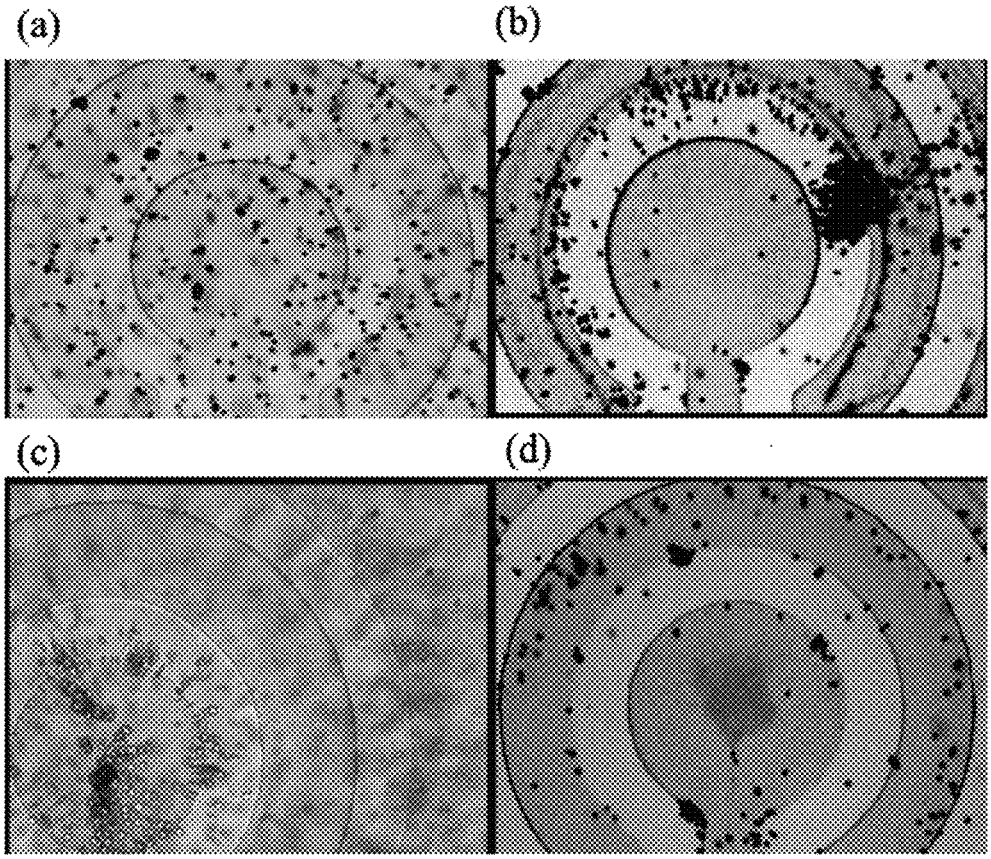
FIG. 6 shows photographs illustrating the results for separating blood cells ($5\times10^6$ cells/mL) and bacteria ($10^7$ CFU/mL) of a mixture sample and concentrating the bacteria using the bio-chip of the first preferred embodiment at different frequencies, i.e., (a) at the frequency of zero, (b) at the frequency of 400 Hz, (c) at the frequency of 3000 Hz, and (d) at the frequency of 800 Hz.

Referring to FIG. 6, a blood sample with a blood cell concentration of $5\times10^6$ cells/ml, a bacteria concentration of $10^7$ CFU/ml, and a buffer conductivity that is adjusted to be lower than 1 mS/cm, was under investigation with respect to different frequencies of applied AC voltages from the power source 14. As the frequency was zero (i.e., no voltages applied to all the electrodes), the blood cells and the bacteria were randomly dispersed in the blood sample (as shown in FIG. 5(*a*)), which is almost not applicable to perform the Raman spectroscopy for bacteria detection. When the power source 14 supplied AC voltages with frequency of 400 Hz for about one minute, the positive and negative DEP forces respectively exerted onto the bacteria and the blood cells were much larger than the EHD force (for a low conductivity solution, EHD referred to electroosmosis flow), so that the bacteria were transported to and absorbed on the inner electrode 12 and the first and second outer electrodes 131 and 132, and the blood cells were expelled by the inner electrode 12 and the first and second outer electrodes 131 and 132, (as shown in FIG. 5(*b*)). When the power source 14 supplied biased AC voltages with the frequency of 3000 Hz for about one minute, the EHD forces of the blood cells and the bacteria were much larger than the negative and positive DEP forces, such that the blood cells and the bacteria were transported to and concentrated on the inner electrode 12 by the AC electroosmosis flows (as shown in FIG. 6(*c*)). When the power source 14 supplied biased AC voltages with the frequency of 800 Hz for about one minute, the negative DEP force for the blood cells was stronger than the EHD force, so as to expel the blood cells from the inner electrode 12. The positive DEP force for the bacteria was weaker than the EHD force, thereby transporting and concentrating the bacteria substantially on the inner electrode 12 (as shown in FIG. 6(*d*)). Raman spectroscopy thus may be performed on the inner electrode 12 to detect the bacteria concentrated on the inner electrode 12.

Figure 7:
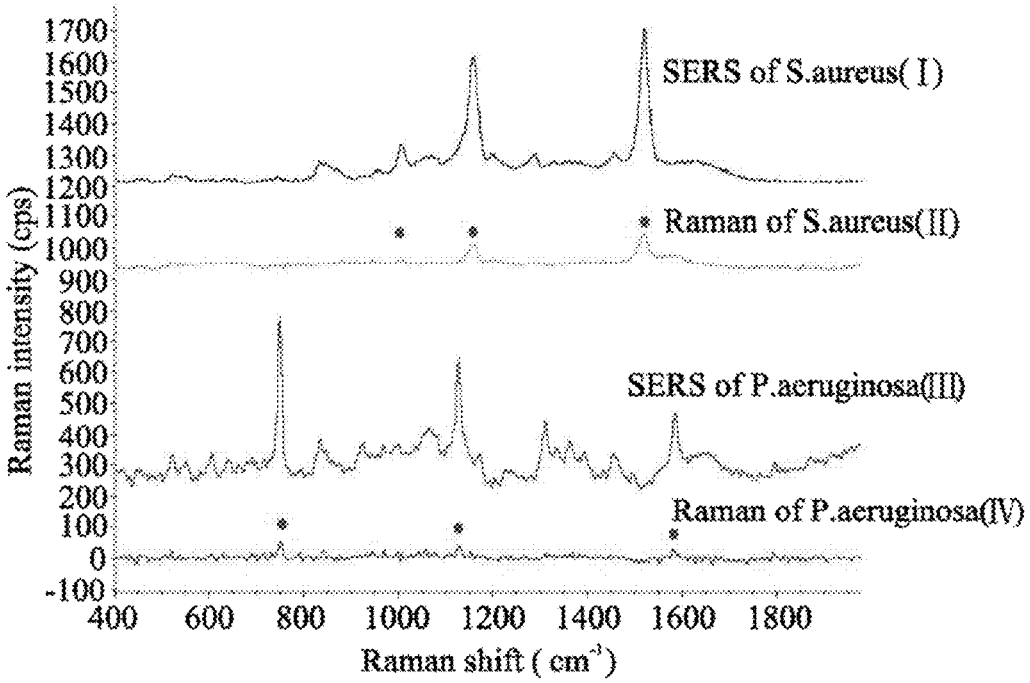
FIG. 7 shows Raman spectra for *S. aureus* samples respectively obtained from a method using the bio-chip of the first preferred embodiment (spectrum (I)) and a ring stain method (spectrum (II)), and for *P. aeruginosa* samples respectively obtained from a method using the bio-chip of the first preferred embodiment (spectrum (III)) and a ring stain method (spectrum (IV))

Further, two kinds of common bacteria, *S. aureus* and *P. aeruginosa*, were adopted separately as detecting targets for further examination. Referring to FIG. 7, two exemplary samples were prepared in a manner that one of the samples contains *S. aureus* with a bacterial concentration of $10^8$ CFU/ml and the other one of the samples contains *P. aeruginosa* with a bacterial concentration of $10^8$ CFU/ml. 50 μL of each sample was loaded to the bio-chip of the present invention separately. 8 Vpp, 12 Vpp of AC voltages with a frequency of 800 Hz were supplied to the first and the second outer electrodes 131 and 132, and the inner electrode 12 was grounded and applied with 0.5 V of a DC voltage such that a non-uniform electric field of $10^5$ V/m was generated. After 2 minutes, Raman spectroscopy was performed on the inner electrode 12, and Raman spectroscopic fingerprints of *S. aureus* (spectrum I) and *P. aeruginosa* (spectrum III) were obtained and are shown in FIG. 7. On the other hand, two comparative samples, containing merely *S. aureus* and merely *P. aeruginosa*, with a concentration of $10^8$ CFU/ml were dropped on a smooth metal surface. After 25 minutes, ring stains (coffee ring) were formed, followed by performing Raman spectroscopy detection so as to obtain respective Raman spectroscopic fingerprints of *S. aureus* (spectrum II) and *P. aeruginosa* (spectrum IV). By comparing spectroscopic fingerprints, intensities of the Raman spectroscopic fingerprints of the exemplary samples of this invention were enhanced by 5 to 30 times as compared to those of the comparative samples.

Figure 8:
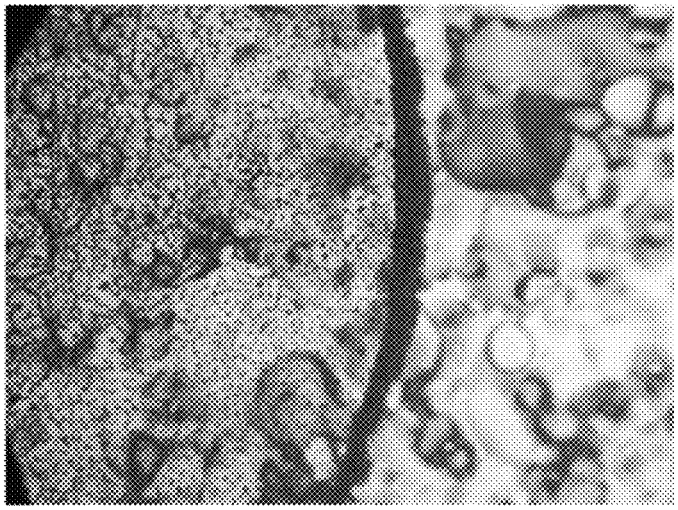
FIG. 8 shows photographs illustrating a ring stain of a sample containing $10^9$ CFU/mL of bacteria (FIG. 8(*a*)), and results of processing samples respectively with $3\times10^4$ CFU/ml and $5\times10^3$ CFU/ml bacteria concentration using the bio-chip of the first preferred embodiment (FIGS. 8(*b*) and 8(*c*))
Figure 8:
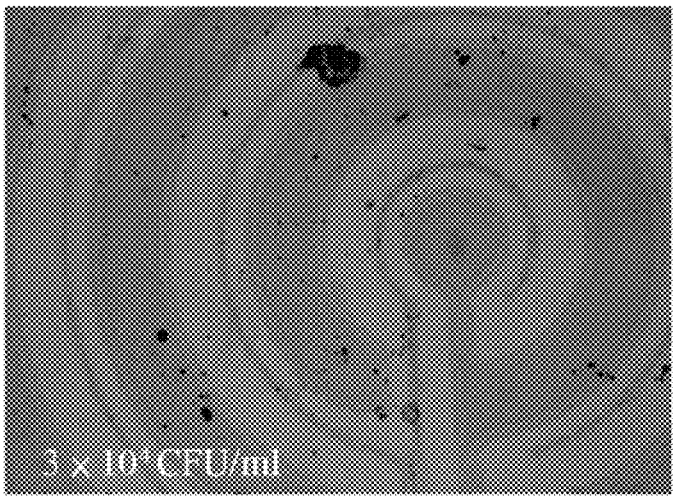
Figure 8:
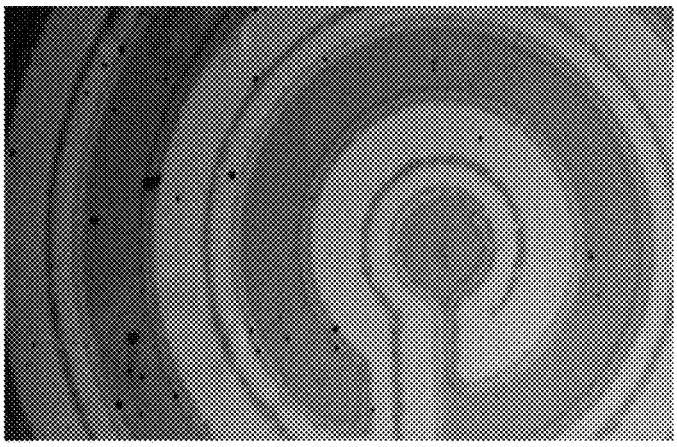

In fact, the ring stains may not be obvious enough for further Raman detection when the bacterial concentration of a sample is low (for example, lower than $10^7$ CFU/ml). FIG. 8(*a*) shows a ring stain formed from a sample with a $10^9$ CFU/ml bacterial concentration which is higher than $10^7$ CFU/ml.

The bio-chip of the present invention is capable of working with samples having low bacterial concentrations. From FIGS. 8(*b*) and 8(*c*), samples having low bacterial concentration such as $3\times10^4$ CFU/ml (FIG. 8(*b*)) and $5\times10^3$ CFU/ml (FIG. 8(*c*)) can be seen on the inner electrode 12 and can be detected after subjected to the method of the present invention for 2 minutes under 8 Vpp and 12 Vpp of AC voltages with a frequency of 800 Hz for the first and the second outer electrodes 131 and 132 and 0.5 V of a DC voltage for the inner electrode 12.

Figure 9:
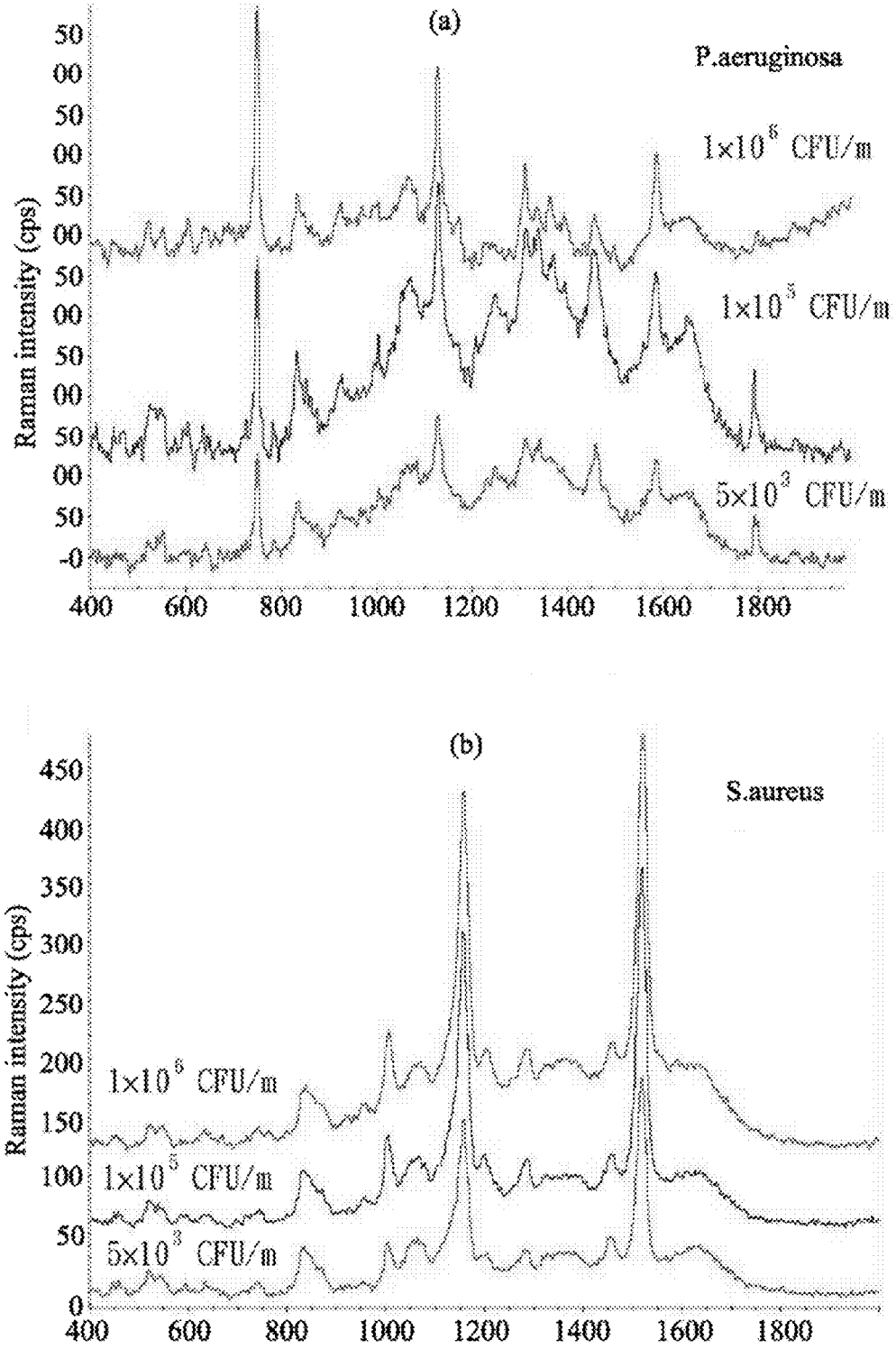
FIG. 9(*a*) shows Raman spectra for samples that contain different concentrations of *P. aeruginosa* and that are processed by the bio-chip of the first preferred embodiment according to the present invention, and FIG. 9(*b*) shows Raman spectra for samples that contain different concentrations of *S. aureus* and that are processed by the bio-chip of the first preferred embodiment according to the present invention.

FIGS. 9(*a*) and 9(*b*) respectively show the Raman spectra for *P. aeruginosa* and *S. aureus* with different bacteria concentrations. Samples with different bacteria concentrations were applied to the bio-chip of the present invention and subjected to the method of this invention for 2 minutes. As shown in FIGS. 9(*a*) and 9(*b*), regardless of the bacteria concentrations in the samples, the resultant Raman spectra have similar profiles. Although the peak intensity of the Raman spectra was reduced in the sample with lower bacterial concentration, i.e., $5\times10^3$ CFU/mL, the characteristic peaks were still recognizable for species determination.

Furthermore, a relationship between the frequency of the applied AC voltages from the power source 14 of the bio-chip according to the present invention and the detection limit of the bio-chip was investigated. In this experiment, samples with blood cells and each of three kinds of common bacteria for Bacteremia, *S. aureus, P. aeruginosa*, and *E. coli*, were used for investigation. The detection limit for each of *S. aureus, P. aeruginosa*, and *E. coli* samples with respect to the frequency is listed in Table 1. As shown in Table 1, the three kinds of bacteria can be detected at a relatively low concentration ($10^3$ CFU/mL level) which is close to a bacterial concentration in a subject suffered from Bacteremia. The optimal frequency for determining these three common bacteria was 800 Hz. Based on the experiment conductedby the Applicant, the bio-chip of this invention can be efficiently separating and concentrating the desired particles at a frequency ranging from 600 Hz to 2000 Hz; preferably, from 600 Hz to 1000 Hz; more preferably, from 700 Hz to 900 Hz; most preferably, from 700 Hz to 800 Hz. In view of the above, the method and the bio-chip of this invention can be effectively used to detect the pathogenic bacteria at a relatively low bacterial concentration.

TABLE 1

| | *E. coli* | *S. aureus* | *P. aeruginosa* |
|---|---|---|---|
| 700 Hz | $3\times10^4$ CFU/ml | $5\times10^3$ CFU/ml | $1\times10^4$ CFU/ml |
| 800 Hz | $3\times10^4$ CFU/ml | $3\times10^3$ CFU/ml | $5\times10^3$ CFU/ml |
| 900 Hz | $5\times10^4$ CFU/ml | $1\times10^4$ CFU/ml | $1\times10^4$ CFU/ml |
| 1000 Hz | $5\times10^4$ CFU/ml | $1\times10^5$ CFU/ml | $1\times10^4$ CFU/ml |

Figure 10:
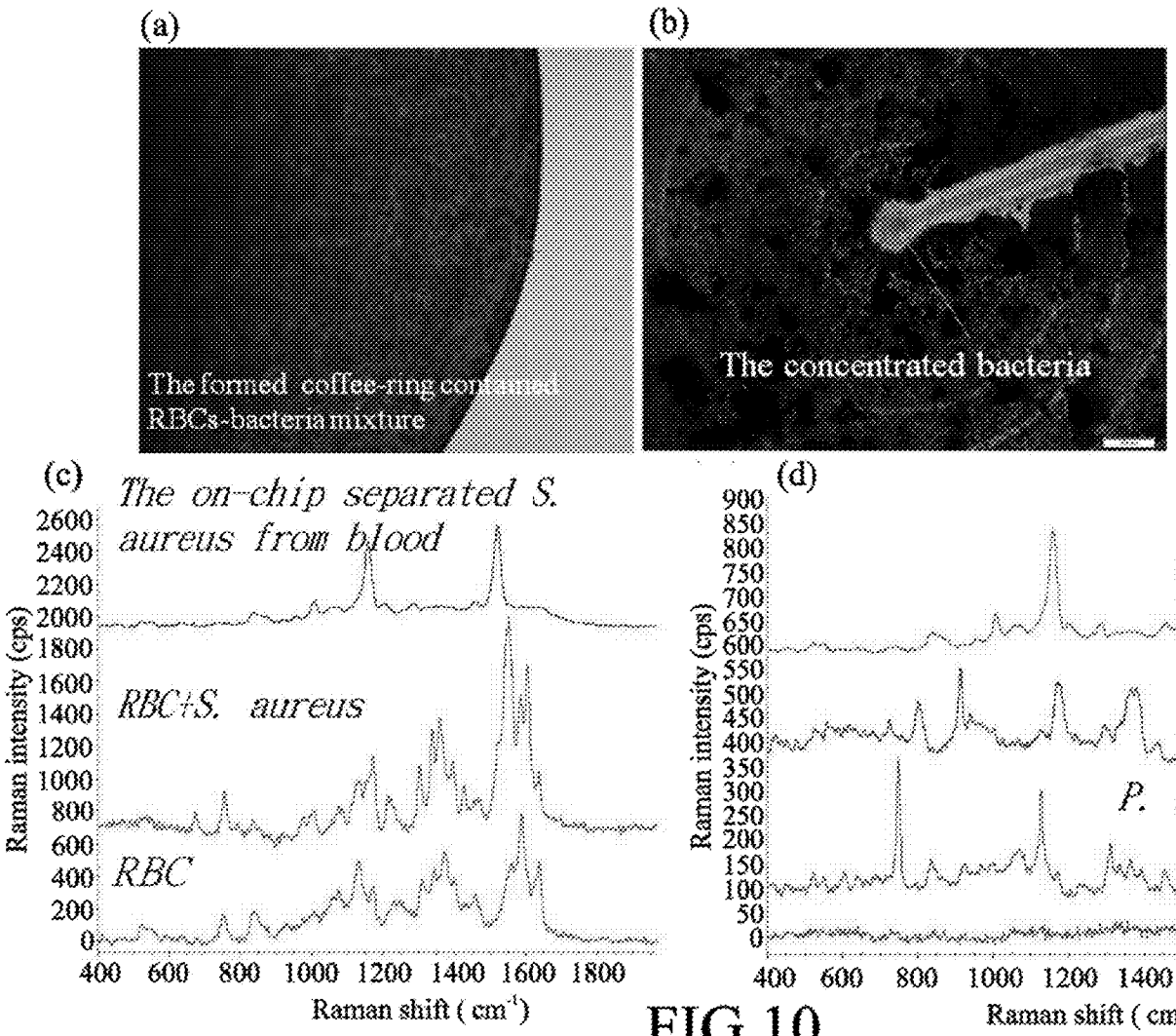
FIG. 10(*a*) is a photograph of a ring stain of a sample containing red blood cells and bacteria after 15 minutes of evaporation, FIG. 10(*b*) is a photograph showing the result for processing a sample containing blood cells ($3\times10^8$ cells/mL) and bacteria ($1\times10^5$ CFU/mL) by the bio-chip of the first preferred embodiment according to the present invention, FIG. 10(*c*) shows Raman spectra of samples that contain red blood cells and *S. aureus* and that are respectively processed by the bio-chip of the first preferred embodiment of this invention (spectrum (I)) and by a ring stain method (spectrum (II)), and a Raman spectrum of red blood cells, and FIG. 10(*d*) shows Raman spectra for *S. aureus, E. coli*, and *P. aeruginosa* processed by the bio-chip of the first preferred embodiment of the present invention.
Figure 11A:
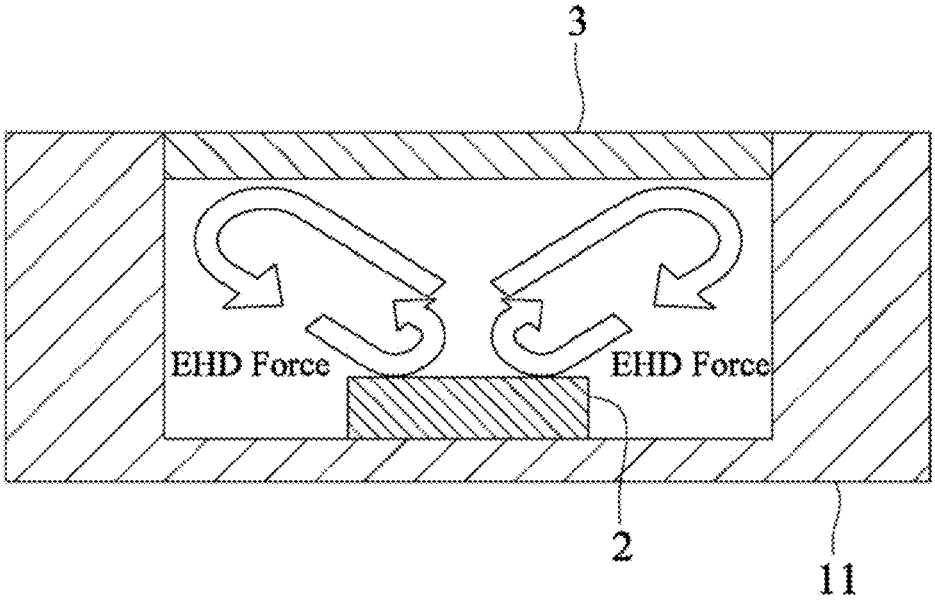
FIG. 11(*a*) is a schematic diagram of a variation of the bio-chip according to the present invention, FIG. 11(*b*) is a top view of a bottom electrode of the variation of the bio-chip, FIG. 11(*c*) is a top view of a variation of the bottom electrode of the variation of the bio-chip, and FIG. 11(*d*) is a top view of the bottom electrode and an auxiliary bottom electrode of the variation of the bio-chip.
Figure 11B:
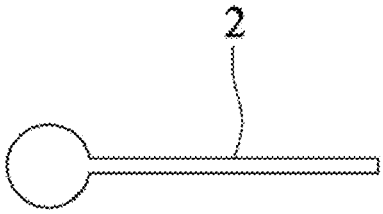
Figure 11C:
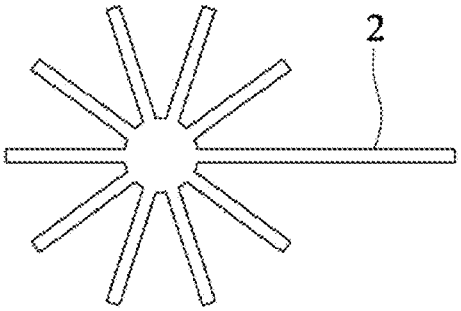
Figure 11D:
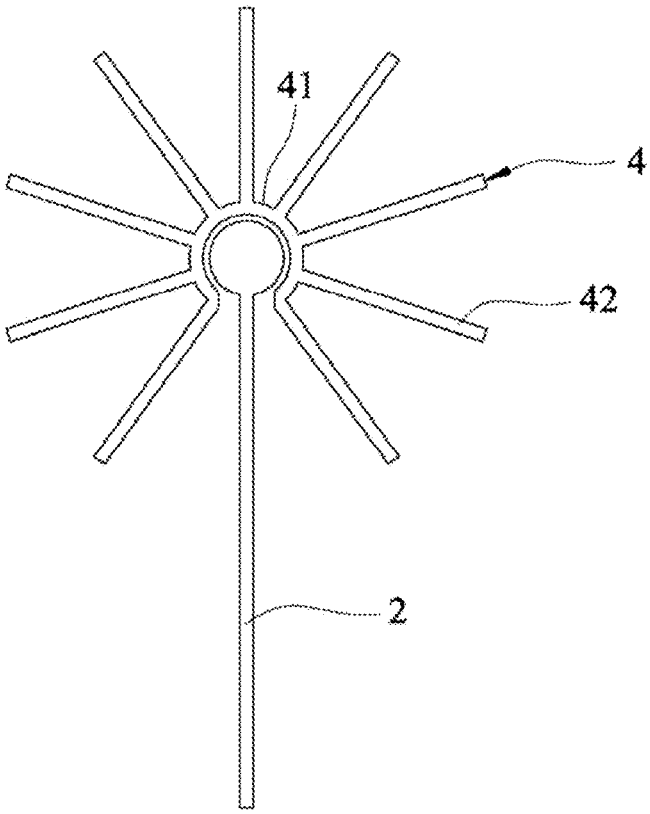

FIG. 10(*a*) is a ring stain (coffee ring) for a sample containing red blood cells with a blood cell concentration of around $2\times10^8$ cells/ml and bacteria (*S. aureus*) with a bacterial concentration of around 1 f $10^5$ CFU/ml. As shown in 10(*a*), after 15 minutes of evaporation, the blood cells and the bacteria in the sample were randomly disposed in the ring stain, which is nearly not applicable to perform Raman spectroscopy for further genus/species detection.

FIG. 10(*b*) shows the result of separating and concentrating bacteria ($1\times10^5$ CFU/mL) from blood cells ($2\times10^8$ cells/mL) in a mixture sample (50 μL) containing the bacteria and the blood cells using the bio-chip and the method of the present invention. The method was conducted for 2 minutes under 8 Vpp and 12 Vpp of AC voltages with a frequency of 800 Hz for the first and the second outer electrodes 131 and 132 and 0.5 V of a DC voltage for the inner electrode 12. As shown in FIG. 10(*b*), about 60% of the bacteria can be concentrated and seen on the inner electrode 12. Raman spectroscopy was performed on the inner electrode 12 and the fingerprint is shown in spectrum (1) of FIG. 10(*c*). Spectrum (1) of FIG. 10(*c*) shows that low concentration of *S. aureus* ($10^8$ CFU/ml) can be separated from the red blood cells ($3\times10^8$ CFU/ml) and concentrated on the inner electrode 12 of the bio-chip of this invention, so that a Raman spectrum for *S. aureus* can thus be obtained.

In FIG. 10(*c*), spectrum (2) was obtained from the sample which contained red blood cells ($10^7$ cells/ml) and *S. aureus* ($10^9$ CFU/ml) and which was prepared via the ring stain method. Spectrum (3) was for red blood cells. As shown in spectra (2) and (3), the Raman spectroscopic fingerprint for *S. aureus* cannot be obtained even through the bacteria concentration is significantly high due to the interference of the Raman spectroscopic fingerprint of the red blood cells.

FIG. 10(*d*) shows Raman fingerprints of *S. aureus, E. coli*, and *P. aeruginosa*, each of which was separating from red blood cells and concentrating using the bio-chip and the method of this invention. The blood cell concentration is around $2\times10^8$ cells/ml and the bacterial concentration of each species of the bacteria is around $1\times10^5$ CFU/ml. The results reveal, that the bio-chip and the method of the claimed invention can be used for bacterial detection.

To sum up, by virtue of electrode designs cooperating with the voltage control, the bio-chip of the present invention is capable of concentrating and separating particles effectively in a solution without further purification. Also, by combining with other detecting techniques, for example, spectroscopy techniques (such as Raman spectroscopy, impedance/capacitance/conductance spectroscopy, laser spectrum, mass spectrometry and so forth), optical detection techniques (such as light transmission/reflection/absorption detection, fluorescent labeling and so forth), and antigen-antibody binding, etc., the target particles in the solution can be determined effectively and quickly with the bio-chip of the present invention. Furthermore, the bio-chip of the present invention has advantages such as low-cost, portable, high sensitivity, short detecting time (less than 5 minutes), and label-free.

While the present invention has been described in connection with what are considered the most practical and preferred embodiments, it is understood that this invention is not limited to the disclosed embodiments but is intended to cover various arrangements included within the spirit and scope of the broadest interpretation and equivalent arrangements.

What is claimed is:

1. A bio-chip adapted for separating and concentrating particles in a solution, comprising:

a chip body defining a receiving space therein for receiving the solution;

an inner electrode disposed in said receiving space of said chip body; and an outer electrode unit disposed in said receiving space of said chip body and including a first outer electrode that is spaced apart from and surrounds said inner electrode, and a second outer electrode that is spaced apart from and surrounds said first outer electrode, wherein said inner electrode, said first outer electrode, and said second outer electrode are concentrically disposed, and wherein each of said first and second outer electrodes has an outer periphery and an inner periphery to define a width therebetween, the width of said second outer electrode being greater than that of said first outer electrode.

2. The bio-chip as claimed in claim 1, further comprising a power source electrically connected to said inner electrode, said first outer electrode, and said second outer electrode.

3. The bio-chip as claimed in claim 1, wherein said inner electrode is a circular foil, said first outer electrode being equidistantly spaced apart from said inner electrode, said second outer electrode being equidistantly spaced apart from said first outer electrode.

4. The bio-chip as claimed in claim 3, wherein each of said first and second outer electrodes is an annular foil.

5. The bio-chip as claimed in claim 4, wherein the ratio of the width of said second outer electrode over that of said first outer electrode is not less than 2.828.

6. The bio-chip as claimed in claim 4, wherein the ratio of the distance between said first electrode and said second outer electrode over the distance between said inner electrode and said first outer electrode being not less than 2.828.

7. The bio-chip as claimed in claim 1, wherein said inner electrode has a roughened binding surface that is formed with a plurality of nano-structures.

8. The bio-chip as claimed in claim 1, wherein said inner electrode includes a probe thereon.

9. The bio-chip as claimed in claim 8, wherein said probe is an antibody probe or a nucleic acid probe.

10. The bio-chip as claimed in claim 2, wherein said power source generate is capable of supplying biased AC voltages to said inner electrode, said first outer electrode, and said second outer electrode such that non-uniform AC electric fields ranging from $10^4$ to $10^8$ V/m are generated between two adjacent ones of said inner electrode, and said first and second outer electrodes.

11. The bio-chip as claimed in claim 2, wherein said bio-chip further includes at least one auxiliary outer electrode unit having a first auxiliary outer electrode that is spaced apart from and surrounds said second outer electrode, and a second auxiliary outer electrode that is spaced apart from and surrounds said the first auxiliary outer electrode, said power source being electrically connected to said first and second auxiliary outer electrodes and is capable of supplying biased AC voltages to generate non-uniform AC electric fields from $10^4$ to $10^8$ V/m between two adjacent ones of said inner electrode, said first and second outer electrodes, and said first and second auxiliary outer electrodes.

12. The bio-chip as claimed in claim 1, wherein said bio-chip is used with a Raman spectrometer.

13. A method for separating and concentrating particles in a solution, comprising the following steps of:

(a) providing a solution containing a plurality of first particles with a first average diameter and a plurality of second particles with a second average diameter smaller than the first average diameter;

(b) providing a bio-chip including a chip body defining a receiving space therein, an inner electrode disposed in the receiving space of the chip body, and an outer electrode unit disposed in the receiving space of the chip body and including a first outer electrode that is spaced apart from and surrounds the inner electrode, and a second outer electrode that is spaced apart from and surrounds the first outer electrode;

(c) placing the solution in the receiving space of the chip body of the bio-chip; and (d) applying a biased AC voltage to generate non-uniform AC electric fields between the adjacent two of the inner electrode and the first and second outer electrodes such that an electrohydrodynamics (EHD) force is generated in the solution, such that each of the first particles is subjected to a first dielectrophoresis (DEP) force that is greater than the EHD force, and such that each of the second particles is subjected to a second dielectrophoresis (DEP) force that is smaller than the EHD force, wherein in step (b), the inner electrode, the first outer electrode, and the second outer electrode are concentrically disposed, wherein in step (b), each of the first and second outer electrodes has an outer periphery and an inner periphery to define a width therebetween, the width of the second outer electrode being greater than that of the first outer electrode.

14. The method as claimed in claim 13, wherein, in step (a), the ratio of the first average diameter over the second average diameter is not less than 1.5 when the first and second average diameters of the first and second particles are respectively in a micrometer scale.

15. The method as claimed in claim 13, wherein, in step (a), the ratio of the first average diameter over the second average diameter is not less than 10 when the first and second average diameters of the first and second particles are respectively in a nanometer scale.

16. The method as claimed in claim 13, wherein in step (b), each of the first and second outer electrodes is an annular foil.

17. The method as claimed in claim 16, wherein in step (b), the ratio of the width of the second outer electrode over that of the first outer electrode is not less than 2.828.

18. The method as claimed in claim 16, wherein the ratio of the distance between the first outer electrode and the second outer electrode over the distance between the inner electrode and the first outer electrode being not less than 2.828.

19. The method as claimed in claim 13, wherein in step (b), the inner electrode has a roughened binding surface that is formed with a plurality of nano-structures.

20. The method as claimed in claim 13, wherein in step (b), the inner electrode includes a probe thereon.

21. The method as claimed in claim 20, wherein in step (b), the probe is an antibody probe or a nucleic acid probe.

22. The method as claimed in claim 13, wherein, in step (b), the AC electric field between the adjacent two of the inner electrode, the first outer electrode, and the second outer electrode ranges from $10^4$ to $10^8$ V/m.

* * * * *